US008053379B2

(12) United States Patent
Tingle et al.

(10) Patent No.: US 8,053,379 B2
(45) Date of Patent: Nov. 8, 2011

(54) POLYESTER WOVEN FABRIC

(75) Inventors: Douglas R. Tingle, Griffin, GA (US); Jefferson Franklin Stewart, McDonough, GA (US)

(73) Assignee: 1888 Mills, Griffin, GA (US)

( * ) Notice: Subject to any disclaimer, the term of this patent is extended or adjusted under 35 U.S.C. 154(b) by 0 days.

(21) Appl. No.: 12/566,866

(22) Filed: Sep. 25, 2009

(65) Prior Publication Data

US 2010/0015874 A1 Jan. 21, 2010

Related U.S. Application Data

(63) Continuation of application No. 11/851,101, filed on Sep. 6, 2007, now abandoned, which is a continuation-in-part of application No. 11/249,760, filed on Oct. 12, 2005, now abandoned.

(60) Provisional application No. 60/698,789, filed on Jul. 13, 2005.

(51) Int. Cl.
*D03D 13/00* (2006.01)
*B32B 3/02* (2006.01)

(52) U.S. Cl. ..... 442/203; 428/92

(58) Field of Classification Search ..... 442/203, 442/189

See application file for complete search history.

(56) References Cited

U.S. PATENT DOCUMENTS

| | | | | |
|---|---|---|---|---|
| 4,263,364 | A | 4/1981 | Seymour et al. | |
| 4,670,326 | A | 6/1987 | Heiman | |
| 4,724,183 | A | 2/1988 | Heiman | |
| 5,486,500 | A | 1/1996 | Kaufman | |
| 5,495,874 | A | 3/1996 | Heiman | |
| 5,723,510 | A | 3/1998 | Kabumoto et al. | |
| 5,960,621 | A * | 10/1999 | Scheerer et al. | 57/210 |
| 6,062,272 | A * | 5/2000 | Waite | 139/420 A |
| 6,548,431 | B1 | 4/2003 | Bansal et al. | |
| 2004/0229538 | A1 * | 11/2004 | Love et al. | 442/182 |
| 2005/0031828 | A1 | 2/2005 | Yoshida | |
| 2005/0062010 | A1 * | 3/2005 | Fang et al. | 252/8.62 |
| 2005/0081939 | A1 * | 4/2005 | Heiman | 139/25 |
| 2005/0202741 | A1 * | 9/2005 | Onodera et al. | 442/189 |
| 2007/0014967 | A1 | 1/2007 | Tingle et al. | |
| 2008/0057813 | A1 | 3/2008 | Tingle et al. | |

* cited by examiner

*Primary Examiner* — Lynda Salvatore

(74) *Attorney, Agent, or Firm* — Troutman Sanders LLP; Ryan A. Schneider; Robert R. Elliott, Jr.

(57) ABSTRACT

A polyester garment material including a set of 100% polyester warp yarns and a set of 100% polyester weft yarns, wherein the warp and weft yarns are interlaced to form the garment material. The warp and weft yarns comprise of air-jet spun polyester fibers that wisk moisture away from an individual wearing the garment material and, therefore, provide a quick-drying, breathable garment material that simulates the absorbency characteristics of cotton yarns. The set of polyester warp yarns and the set of polyester weft yarns may be interlaced to form a ground fabric, where a set of polyester pile yarns may then be interlaced with the ground fabric so that the pile yarns extend outwardly (e.g., forming a plurality of loops) on the front side, back side, or both sides of the ground fabric.

40 Claims, 5 Drawing Sheets

POLYESTER WOVEN FABRIC

CROSS REFERENCE TO RELATED APPLICATION AND CLAIM OF BENEFIT

This application is a continuation of U.S. patent application Ser. No. 11/851,101, filed 6 Sep. 2007, now abandoned, which claims the benefit of and is a continuation-in-part of U.S. patent application Ser. No. 11/249,760, filed 12 Oct. 2005, now abandoned, which claims the benefit of U.S. Provisional Application 60/698,789, filed on 13 Jul. 2005. All of said patent applications are hereby incorporated by reference as if fully set forth below

TECHNICAL FIELD

The present invention relates, generally, to woven fabrics, and, more particularly, to polyester woven fabric garments, including, for example, patient/isolation gowns, lab coats, chef-cook coats/shirts/pants, work shirts/pants/vests, robes, and aprons.

BACKGROUND OF THE INVENTION

Woven fabrics are commonly used for garments, including, for example, patient/isolation gowns, lab coats, chef-cook coats/shirts/pants, work shirts/pants/vests, robes, and aprons, and sheets, towels, pillow cases, blankets, and other related items. Traditionally, the fabrics for garments are often woven with a natural fiber, such as cotton or silk. For institutional use, namely with linens, plain woven sheeting materials often comprise a blend of natural materials and synthetic materials. More particularly, woven sheeting made specifically for industrial use often comprises equal quantities of natural and synthetic materials or, more often, considerably more synthetic materials than natural materials.

Regarding sheeting, institutions including, but not limited to, hospitals, prisons, rest homes, nursing homes, and hotels require woven sheeting materials that provide comfort and durability. Although the comfort of woven sheeting materials may be somewhat subjective, the comfort of cotton sheeting is commonly preferred by the industry. Additionally, cotton sheeting has adequate absorbency characteristics that leave one's skin dry during use. The comfort and absorbency of cotton sheeting is important in institutional use such as hospitals, because the comfort of the sheeting contributes to the positive outlook of the patient, while the absorbency of the sheeting minimizes the occurrence of infections. Unfortunately, cotton sheeting has a relatively short period of acceptable use. The life expectancy of woven sheeting is primarily related to the number of times the sheeting is laundered and/or ironed. Many institutions change woven sheeting materials daily and other institutions may change sheeting materials multiple times a day. Consequently, most sheeting materials used in institutions receive more wear and tear during laundering and ironing than during typical bed use.

Durability typically refers to the sheeting material's resistance to degradation, including that which occurs during laundering and ironing. The durability of woven sheeting materials relates directly to the institution's overall cost of the sheeting materials. Generally, the total cost of sheeting materials equals the purchase price, plus the costs of laundering and ironing, divided by the number of times the sheeting materials may be used. In the industry, a laundry cycle comprises washing, drying, ironing (if necessary), and steam sterilization (if necessary) of the woven sheeting material.

Accordingly, the greater the number of laundry cycles that a woven sheeting material can endure, the less the overall cost to the institution.

To increase the durability of woven sheeting materials, while maintaining the comfort attributable to cotton sheeting, institutions utilize sheeting materials comprising a blend of natural and synthetic fibers (i.e., cotton and polyester). The use of synthetic resin yarns, such as polyester, has greatly increased the durability of sheeting materials. Polyester comprises durability characteristics suitable for institutional use in which sheeting materials require frequent laundering and sterilization. Not only does polyester provide greater durability than cotton, but polyester also requires less laundering time, because it dries more quickly ("quick-drying") and often does not require ironing. Compared to 100% cotton sheets, 50% polyester and 50% cotton sheets generally require 25-30% less drying energy during laundering and have a life expectancy of almost twice that of 100% cotton sheets (e.g., 50-60 laundry cycles for 100% cotton sheets compared to 90-110 laundry cycles for 50% cotton and 50% polyester sheets). Cotton sheets, on the other hand, absorb stains within the natural fiber and, therefore, present problems for laundering. Consequently, even sheets of 50% cotton and 50% polyester have limited life spans, because the use of large, commercial washers damages the natural fibers. Furthermore, the use of cotton within the sheeting material becomes problematic, because the cotton fibers typically absorb stains and, therefore, require longer wash cycles for the removal of the stains. Another major problem with the use of cotton fibers arises from the use of large, commercial dryers for drying the washed sheets. The large dryers produce extreme centrifugal forces for removing the water which is absorbed in the cotton fibers during the wash cycle. Accordingly, the presence of cotton and its propensity for absorbing stains and water greatly increases the washing and drying times, which translates into added costs for institutions. Additionally, during the washing and drying cycles, cotton fibers are greatly weakened, resulting in a reduction in the total life span of the sheet.

Polyester is generally produced from molten polymer after a filtration process to remove any impurities. The molten polymer may be spun directly, or it may be extruded, cooled and cut into small pellets or chips, which can be stored for later extrusion. The extrusion process involves metering molten polymer through a spinneret to create filaments that solidify in cooling air. The filaments must be drawn to orient the polymer and develop the fiber properties of the filament. For example, the fiber may be completely drawn after extrusion, or it may be partially drawn to form partially oriented yarn (POY). The yarns, therefore, may be textured at a later processing step. One procedure for producing polyester produces yarns formed by an extrusion process that produces filaments of extremely small cross sections (similar to the size of cotton fibers). These continuous filaments may be joined with, or without, a minimal twist to form a yarn of any given denier. Another procedure involves a further step of crimping the yarn to create a textured yarn assuming a non-linear configuration. Polyester yarns may be spun into different cross-sectional shapes including, but not limited to, round, trilobal, t-shape, and pentalobal. The polyester yarns produced from the extrusion process may then be plied with a natural yarn (such as cotton) to produce a blended yarn to be used in creating the woven sheeting material. Many other fabric constructions exist that incorporate various combinations of polyester and cotton yarns. Instead of plying the yarns together, the polyester and cotton yarns may be used as both warp and weft yarns within a woven sheeting material. While there may exist multiple combinations and permutations of natural and synthetic yarns, only a very limited number of yarn constructions will satisfy the demands made by institutions for durability and comfort.

Although the use of different sized fibers of polyester may be used to create a more comfortable sheeting material, producers of woven sheeting materials do not generate 100% polyester sheeting for institutional use, because, unlike cotton yarns, polyester yarns do not have adequate absorbency characteristics. Currently, materials comprising 100% polyester are generally non-woven and do not properly "breathe," resulting in a pool of sweat when used by an individual in an institutional setting. Thus, 100% polyester materials are solely used for tablecloths and the like.

Examples of woven sheeting materials or woven fabric materials are disclosed in U.S. Pat. Nos. 4,670,326, 4,724,183, and 5,495,874 to Heiman. In U.S. Pat. Nos. 4,670,326 and 4,724,183, Heiman discloses a woven sheeting material with warps and wefts yarns, wherein each of the warps is made of a blend of a natural material, such as cotton, and a synthetic material, such as polyester, and each of the wefts are made entirely of natural materials, such as cotton. In U.S. Pat. No. 5,495,874, Heiman discloses a woven fabric sheeting that comprises of cotton warp yarns and continuous filament, texturized, polyester filling yarns. While satisfying its intended purpose, the woven sheeting materials and woven fabric materials disclosed by Heiman have significant disadvantages, because of the use of natural materials (e.g., cotton). Such woven sheeting materials possess a shorter life expectancy, because natural materials absorb stains and, therefore, require longer washing and drying cycles during laundering. Extended laundering weakens the natural materials in the woven sheeting material, thus, requiring institutions to replace the sheeting material more frequently. Consequently, the use of woven sheeting material with natural materials increases costs for institutions requiring frequent laundering. These increase costs include more energy and time for laundering, as well as replacement costs.

There is, therefore, a need in the industry for a woven garment material that is durable and, therefore, maximizes the number of laundry cycles during the lifetime of the garment material and, thus, reduces overall replacement costs.

Also, there is a need in the industry for a woven garment material that is comfortable and, therefore, possesses an adequate absorbency rate to ensure breathability.

Additionally, there is a need in the industry for a woven garment material that reduces the amount of laundering time and ironing and, therefore, has a lower total cost than currently used woven garment materials.

There is also, therefore, a need in the industry for a woven sheeting material that is durable and, therefore, maximizes the number of laundry cycles during the lifetime of the sheeting material and, thus, reduces overall replacement costs.

Also, there is a need in the industry for a woven sheeting material that is comfortable and, therefore, possesses an adequate absorbency rate to ensure breathability.

Additionally, there is a need in the industry for a woven sheeting material that reduces the amount of laundering time and ironing and, therefore, has a lower total cost than currently used woven sheeting materials.

SUMMARY OF THE INVENTION

Briefly described, the present invention includes a 100% polyester woven material useful specifically as garment material, for example, patient/isolation gowns, lab coats, chef-cook coats/shirts/pants, work shirts/pants/vests, robes, and aprons. More particularly, the present invention includes a set of 100% polyester warp yarns and a set of 100% polyester weft yarns, wherein the warp and weft yarns are interlaced to form a garment material. The warp and weft yarns comprise of air-jet spun polyester fibers and each warp and weft yarns may comprise two or more single strands of polyester yarns to form a single plied yarn. The air-jet spun polyester yarns wisk moisture away from an individual wearing the woven garment material and, therefore, provide a quick-drying, breathable woven garment material that simulates the absorbency characteristics of cotton yarns. Further, the 100% polyester woven garment material can possess desirable characteristics including, but not limited to, a limited amount of dimensional change after laundering, a desirable stain release rating, an improved absorbency of moisture, and a desirable breaking strength (e.g., tensile strength).

In an alternative embodiment of the present invention, the set of 100% polyester warp yarns and the set of 100% polyester weft yarns may be interlaced to form a ground fabric. A set of 100% polyester pile yarns may then be interlaced with the ground fabric so that the pile yarns extend outwardly on the front side, back side, or both sides of the ground fabric. Additionally, the pile yarns may form a plurality of loops on the front side, back side, or both sides of the ground fabric. The plurality loops assist in the wisking away of moisture from an individual using the woven garment material.

Accordingly, an object of the present invention is to increase the durability of woven garment material to maximize the useful life of the woven garment material.

Another object of the present invention is to increase the comfort of woven garment material by ensuring that the woven garment material has an adequate absorbency rate to ensure breathability.

Still another object of the present invention is to maximize the number of laundry cycles of the woven garment material.

Still another object of the present invention is to reduce the amount of laundering time and ironing necessary to clean the woven garment material and, consequently, reducing the total cost of using the woven garment material.

Still another object of the present invention is to provide institutions such as hospitals, prisons, hotels, rest homes, and nursing homes with a more cost-efficient woven garment material that performs to the standards required by institutional use.

Other objects, features, and advantages of the present invention will become apparent upon reading and understanding the present specification when taken in conjunction with the appended drawings.

DETAILED DESCRIPTION OF THE INVENTION

Figure 1:
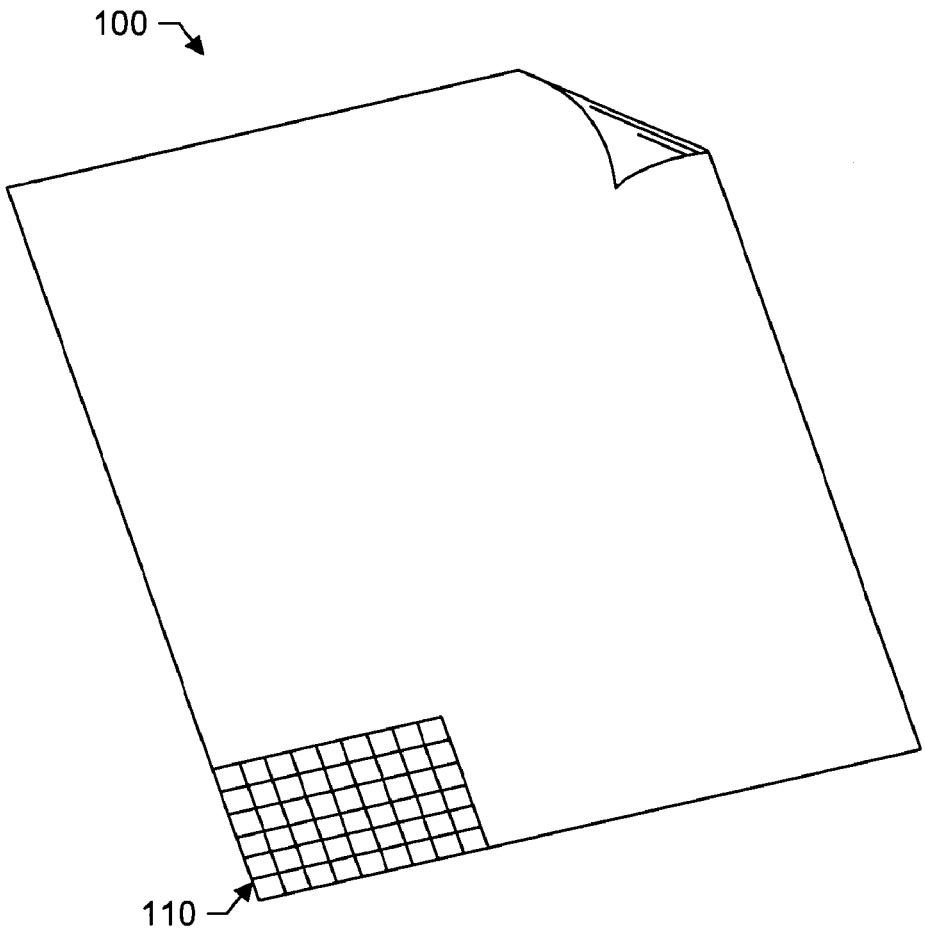
FIG. 1 displays a perspective view of a polyester woven fabric in accordance with an exemplary embodiment of the present invention, having one corner thereof folded over and an enlarged corner-section illustrating the woven polyester yarns therein.

Referring now to the drawings, in which like numerals represent like components or steps throughout the several views, FIG. 1 displays a perspective view of a polyester woven fabric in accordance with an exemplary embodiment of the present invention, having one corner thereof folded over and an enlarged corner-section 110 illustrating the woven polyester yarns therein. The woven garment material 100 may be specifically adapted for garments, or institutional use in linens (also referred to herein as "sheeting") such as, but not limited to, sheets, towels, pillow cases, blankets, and other related items.

As illustrated in the enlarged corner-section 110, the woven garment material 100 comprises a plurality of warp yarns extending substantially parallel in one direction and a plurality of weft yarns extending substantially parallel in a second direction, where each warp yarn and weft yarn are substantially perpendicular to each other.

Figure 2:
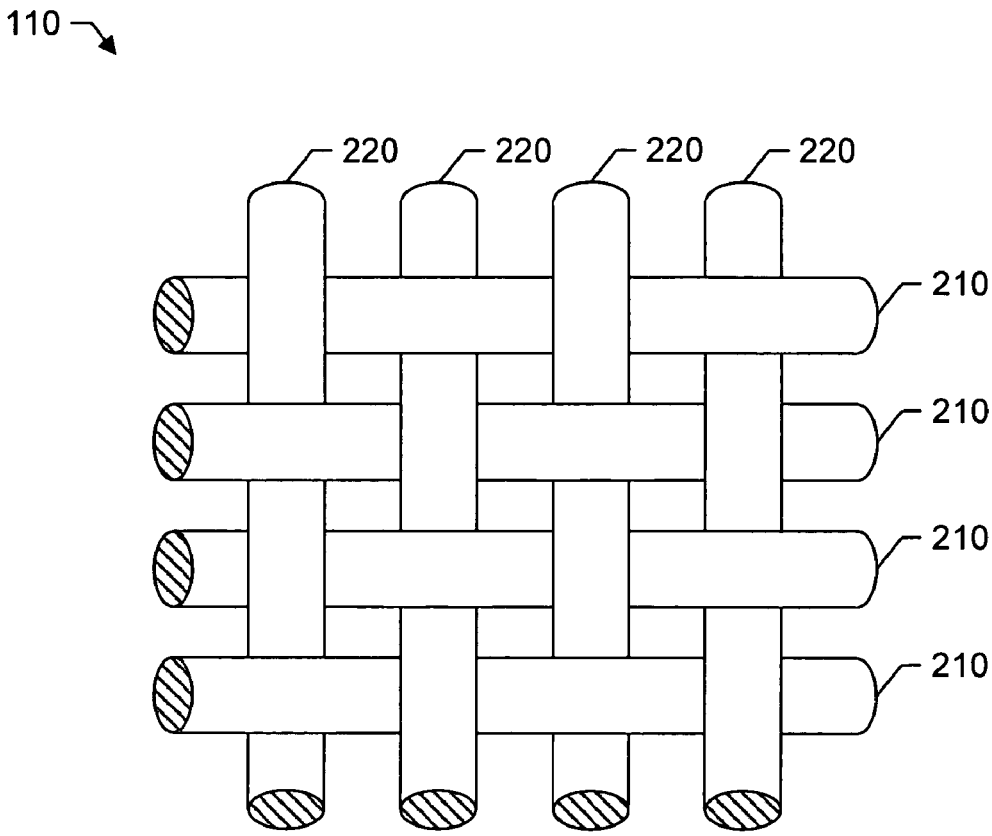
FIG. 2 displays an enlarged fragmentary plan view illustrating the warp and weft yarns of a polyester woven fabric in accordance with an exemplary embodiment of the present invention.
Figure 3:
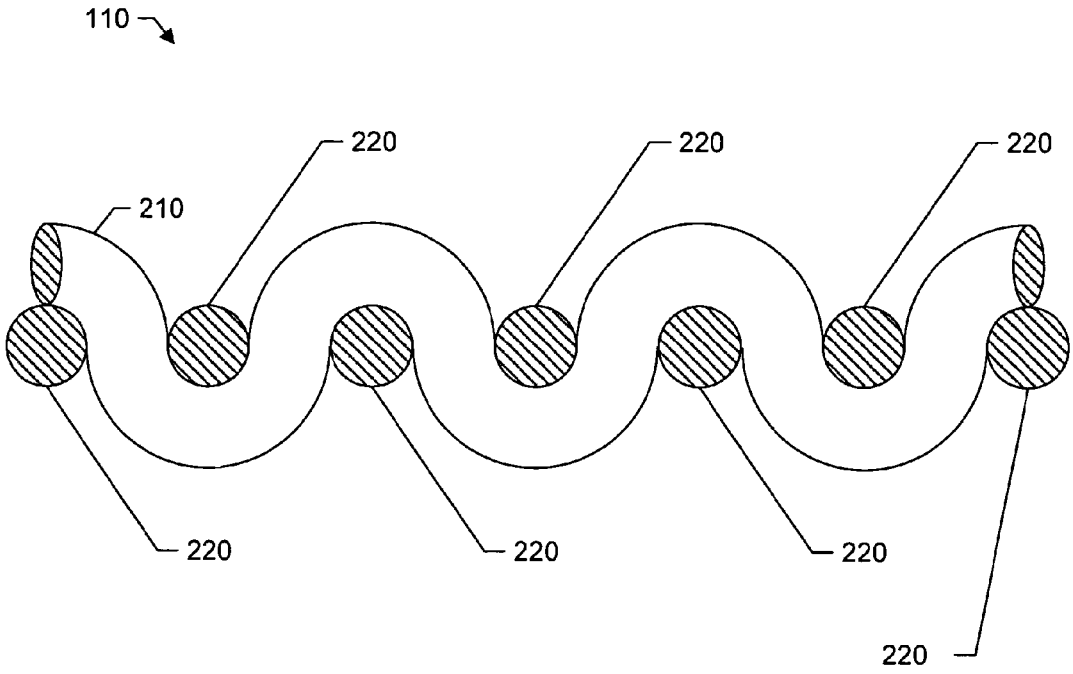
FIG. 3 displays an enlarged fragmentary cross-sectional view illustrating the warp and weft yarns of a polyester woven fabric in accordance with an exemplary embodiment of the present invention.

FIGS. 2 and 3 display a fragmentary plan view and fragmentary cross-sectional view, respectively, illustrating the interlacing warp yarns 220 and weft yarns 210 of the woven garment material 100. As is known by one skilled in the art, woven garment material 100 may typically be created from the weaving of a plurality of warp yarns 220 and a plurality of weft yarns 210, where each warp yarn 220 alternates between intersecting over or intersecting under each weft yarn 210, and vice versa. Various weaving apparatuses and machines exist for the forming of woven garment material 100, but a discussion of such equipment is beyond the scope of the present invention.

In a preferred embodiment of the present invention, the warp yarns 220 and weft yarns 210 comprise of 100% polyester fibers. Polyester fibers provide significant advantages for institutional use. Similar to other manufactured fibers, polyester fibers may be formed in varying lengths and deniers. Polyester fibers are available in microdenier and, consequently, provide a more silk-like feel to woven products. Additionally, polyester fibers may be spun into a wide range of cross-sectional shapes including, but not limited to, round, trilobal, t-shape, and pentalobal. The polyester fibers may also be spun with hollow cores for a plusher feel. Such characteristics may be beneficial to the overall comfort of woven garment material 100.

Compared to natural fibers, polyester fibers have higher tensile strength that lend to better durability. Higher tensile strength ensures that a woven garment material 100 can better withstand the stresses of institutional use and commercial laundering, including, but not limited to, washing, drying, and ironing. Higher tensile strength prolongs the life of woven garment material 100 and, therefore, reduces the total cost of the garment material 100. As described above, the total cost of garment materials 100 equals the purchase price, plus the costs of laundering and ironing, divided by the number of times the garment materials 100 may be used. Accordingly, the greater the number of laundry cycles that the woven garment material 100 can endure, the less the overall cost to the institution. Woven garment material 100 comprising 100% polyester weft yarns 210 and warp yarns 220 may endure over one-hundred and fifty (150) laundry cycles. In the industry, a laundry cycle generally comprises washing, drying, ironing, and steam sterilization. More specifically, commercial laundering typically involves a washing cycle with high temperatures and strong detergents, successive rinsing, a drying cycle with high temperatures, and ironing.

Furthermore, the polyester fibers, unlike cotton fibers, do not absorb stains. Stains are typically positioned in interlaces or crevices between the warp and weft yarns 220, 210. Consequently, the stains are entrapped rather than absorbed. Hence, the stains are easily removed during the washing cycle. Also, unlike natural fibers such as cotton, polyester fibers have a very low absorbency of moisture and gas, even at high levels of relative humidity. This low absorbency ensures that the woven garment material 100 dries quickly (e.g., quick-drying) during laundering and can therefore lead to reduced cleaning costs to the institution.

In a preferred embodiment of the present invention, the weft yarns 210 and warp yarns 220 are air-jet spun. Air-jet spinning, also known as air-vortex spinning, typically involves two air nozzles with opposing air vortexes that twist a drafted sliver (e.g., a loosely combined polyester fiber strand) to form a polyester yarn. The weft yarns 210 and warp yarns 220 may comprise of multiple air-jet spun yarns twisted together to form plied weft and warp yarn 210, 200. The air-jet spun weft yarns 210 and warp yarns 220 enable the woven garment material 100 to wisk moisture away from an individual lying on the garment material 100. The air-jet spun weft yarns 210 and warp yarns 220, therefore, provide a breathability to the woven garment material 100 similar to that of a cotton sheet.

The woven garment material 100 may be made in a balanced weave, where the number of warp yarns 220 is equal to the number of weft yarns 210 in a square inch of fabric, or may be made in an unbalanced weave, where the number of warp yarns 220 is greater than or less than the number of weft yarns 210 in a square inch of fabric. The total number of warp yarns 220 and weft yarns 210 in a square inch of fabric may vary depending on the fabric's intended application. In an exemplary embodiment of the present invention, the total number of warp yarns 220 and weft yarns 210 in a square inch of woven garment material 100 is within the count range of 100 to 300.

In an alternative embodiment of the present invention, the warp yarns 220 and weft yarns 210 are treated with a flame-retardant, antimicrobial finish, or stain-resistant finish. As is known by one skilled in the art, a flame-retardant treatment provides a process for incorporating or adding flame-inhibiting properties to the warp and weft yarns 220, 210; an antimicrobial finish provides a process for incorporating a resistance to the growth of biological organisms such as bacteria or fungi to the warp and weft yarns 220, 210; and a stain-resistant finish provides a process for incorporating a resistance to the absorption of stain causing materials (e.g., water or oil) to the warp and weft yarns 220, 210.

Several woven garment materials 100 comprising 100% polyester weft yarns 210 and warp yarns 220 were examined using multiple test standards. These tests were also conducted to several woven sheets comprising 50% cotton and 50% polyester. The woven garment materials 100 comprising purely polyester weft yarns 210 and warp yarns 220 have been labeled the "sample group," while the woven sheets comprising 50% cotton and 50% polyester have been labeled the "control group."

First, the sample group and control group were tested for dimensional changes after commercial launderings, using the American Association of Textile Chemists and Colorists (AATCC) test method 96-2001 (also referred to as AATCC 96-2001). The AATCC 96-2001 test method is used for the determination of dimensional changes of woven and knitted fabrics made of fibers other than wool, when subjected to laundering procedures commonly used in a commercial laundry. Generally, a range of laundering test procedures from severe to mild are conducted to allow simulation of the types of laundering found in commercial laundry. Specifically, the sample group and control group were subjected to a first laundering before a measurement was conducted of the garment material's lengths (along the edge and along the center) and widths (along the edge and along the center). All laundering cycles included a normal wash at 165° F. with standard detergent and a tumble dry high. Then the woven garment materials were measured after an additional two commercial launderings. The measurement results are displayed in TABLES 1 and 2. The sample group of 100% polyester warp and weft yarns 220, 210 had a lower dimensional change (e.g., shrinkage) in most dimensions than the control group comprising 50% polyester and 50% cotton.

TABLE 1

| Sample Group - 100% Polyester | Original Measurements | After 1 Laundering | Dimensional Change (%) | After 3 Launderings | Dimensional Changes (%) |
|---|---|---|---|---|---|
| Length - Along Edge | 100.125 | 98.500 | −1.6 | 98.375 | −1.7 |
| Length - Along Center | 100.250 | 98.750 | −1.5 | 98.375 | −1.9 |
| Width - Along Edge | 65.750 | 65.125 | −1.0 | 64.875 | −1.3 |
| Width - Along Center | 66.125 | 65.625 | −0.8 | 65.500 | −0.9 |

TABLE 2

| Control Group - 50% Cotton/ 50% Polyester | Original Measurements | After 1 Laundering | Dimensional Change (%) | After 3 Launderings | Dimensional Changes (%) |
|---|---|---|---|---|---|
| Length - Along Edge | 109.125 | 105.625 | −3.2 | 104.750 | −4.0 |
| Length - Along Center | 109.875 | 106.500 | −3.1 | 105.500 | −4.0 |
| Width - Along Edge | 66.000 | 64.500 | −2.3 | 64.000 | −3.0 |
| Width - Along Center | 67.000 | 66.875 | −0.2 | 66.875 | −0.2 |

Second, the sample group and control group were tested for stain release (e.g., oily stain release) using AATCC test method 130-2000. The AATCC 130-2000 test method is designed to measure the ability of fabrics to release oils stains during laundering. The test method is primarily used to evaluate the likely performance of soil release finishes in actual use. Generally, a stain is applied to the test specimen. An amount of the staining substance is forced into the fabric by using a specified weight. The stained fabric is then laundered in a prescribed manner and then the residual stain is rated on a scale from 5 to 1, by comparison with a stain release replica showing a graduated series of stains. Woven garment material 100 with a stain release grade of 5 is considered to possess the best stain removal characteristics, while a woven garment material 100 with a stain release grade of 1 is considered to possess the poorest stain removal characteristics; therefore, the higher the stain release grade, the better the stain removal characteristics. More specifically, the sample group and control group were applied with stains and subjected to a commercial laundering. The laundry cycle included a machine wash at 140° F. with normal detergent and a tumble dry high. As shown in TABLE 3, the control group comprising 100% polyester warp and weft yarns 220, 210 had a stain release grade of 3.5, while the control group comprising of 50% polyester and 50% cotton had a stain release grade of 2.5. Therefore, 100% polyester garment material 100 possesses better stain removal characteristics than a garment material 100 comprising 50% cotton and 50% polyester.

TABLE 3

| Stain Release Rating | |
|---|---|
| Sample Group - 100% Polyester | Control Group - 50% Cotton/50% Polyester |
| 3.5 | 2.5 |

Third, the sample group and control group were tested for absorbency using AATCC test method 79-2000. The AATCC 79-2000 test method tests the "wetability" or absorbency of textile fabrics or yarns. Absorbency is one of several factors that determines the suitability of a fabric for a particular use in the industry. Generally, absorbency is measured in a rate of time (e.g., seconds), where a short amount of time indicates a high absorbency, while a long amount of time indicates a low absorbency. More specifically, five specimens from the sample group and control group were tested using the AATCC 79-2000 test method. As shown in TABLE 4, the specimens of the sample group showed characteristics of high absorbency compared to the specimens of the control group.

TABLE 4

| Specimen | Sample Group - 100% Polyester | Control Group - 50% Cotton/50% Polyester |
|---|---|---|
| | Time in Seconds | |
| 1 | 0.0 | 4.0 |
| 2 | 0.0 | 3.8 |
| 3 | 0.0 | 4.5 |
| 4 | 0.0 | 4.4 |
| 5 | 0.0 | 3.8 |

Fourth, the sample group and control group were tested for tensile strength (e.g., breaking strength) using the American Society for Testing and Materials (ASTM) test method D5034-95(2001). The ASTM D5034-95(2001) test method covers the grab and modified grab test procedures for determining the breaking strength and elongation of most textile fabrics. The test provides values in inch-pound (lbs.) units. As shown in TABLE 5, the sample group comprising 100% polyester warp and weft yarns 220, 210 had greater tensile strength than the control group comprising 50% polyester and 50% cotton.

TABLE 5

| | Sample Group - 100% Polyester | Control Group - 50% Cotton/50% Polyester |
|---|---|---|
| | Average lbs. | |
| Warp Yarn | 134.7 | 104.1 |
| Weft Yarn | 104.7 | 51.6 |

Finally, the sample group and control group were tested for water vapor transmission using the American Society for Testing and Materials (ASTM) test method E96-00 Procedures B. The ASTM E96-00 Procedures B test method covers the determination of water vapor transmission (WVT) of materials through which the passage of water vapor may be of importance. Additionally, the test provides a permeance rating that represents the rate at which water vapor permeates through the material. Generally, permeance is the water vapor transmission of a specific sample under unit vapor pressure difference between two specific surfaces. The test provides the water vapor transmission rate (WVTR) in grams times meters squared divided by twenty-four hours (grams $m^2$/24 hrs) at a temperature of 73° F. at 50% relative humidity. The test provides the permeance in grams divided by the product of pascals, time (in seconds), and meters squared (grams/Pa*s*$m^2$), where E-XX within the result value is equal to $10^{-XX}$. Using the resulting permeance, the U.S. permeance (U.S. perm) can be calculated in grains divided by the product of inches of mercury, time (hour), and ft squared (grains/inHg*h*$ft^2$). As shown in TABLE 6, the sample group comprising 100% polyester warp and weft yarns 220, 210 has a similar water vapor transmission rate and permeance as the control group comprising 50% polyester and 50% cotton. Advantageously, the present invention provides a 100% polyester woven garment material 100 that effectively transfers water vapor and has a permeance substantially equal to a garment material woven of 50% polyester and 50% cotton.

TABLE 6

| | Specimen | | | | | |
|---|---|---|---|---|---|---|
| | Sample Group - 100% Polyester | | | Control Group - 50% Cotton/50% Polyester | | |
| | WVTR | Permeance | U.S. Perm | WVTR | Permeance | U.S. Perm |
| 1 | 735 | 6.6E−06 | 115.5 | 795 | 7.1E−06 | 124.8 |
| 2 | 705 | 6.3E−06 | 110.8 | 724 | 6.5E−06 | 113.7 |
| 3 | 705 | 6.3E−06 | 110.8 | 705 | 6.3E−06 | 110.8 |
| Average | 715 | 6E−06 | 112 | 741 | 7E−06 | 116 |

Figure 4A:
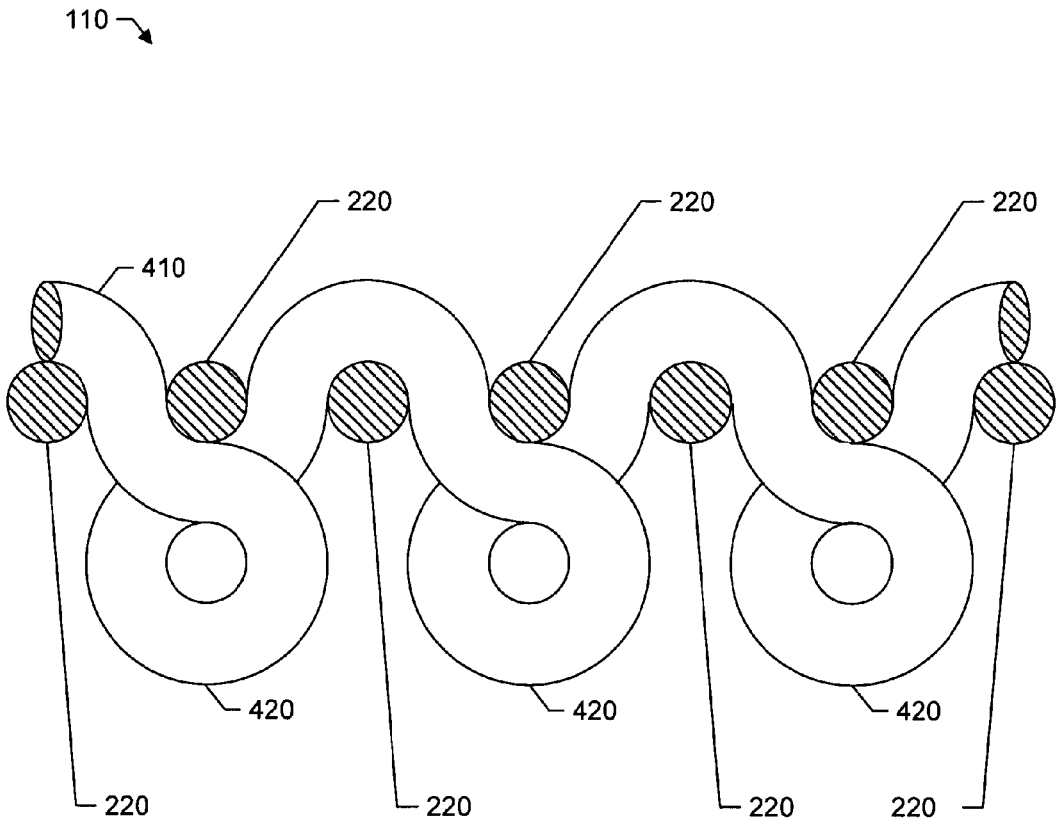
FIGS. 4A-4B display an enlarged fragmentary cross-sectional view illustrating the warp and pile yarns of a polyester woven garment material.
Figure 4B:
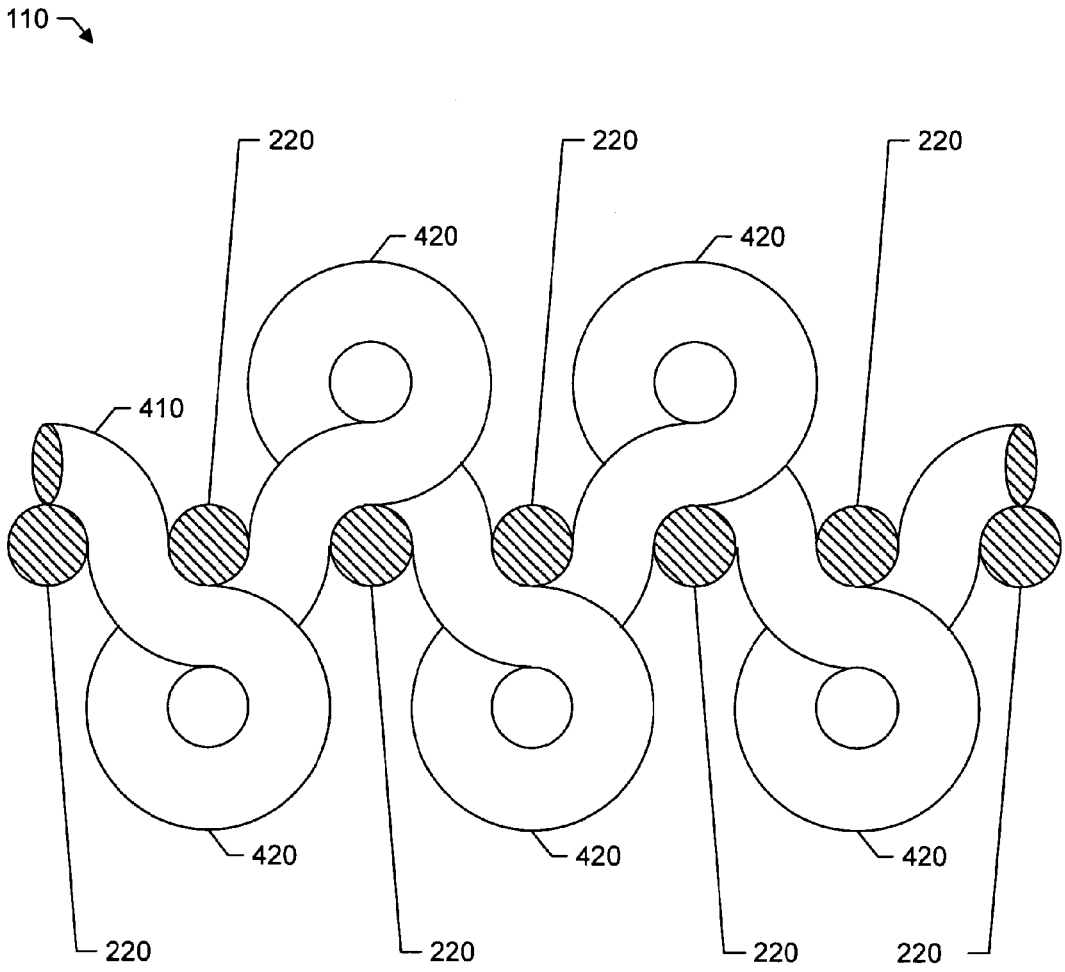

FIGS. 4A-4B display an enlarged fragmentary cross-sectional view illustrating the warp yarns 220 and pile yarns 410 of a polyester woven garment material 100, which may be used as a towel. As is known by one skilled in the art, woven garment material 100 may be created from the weaving of a plurality of warp yarns 220 and a plurality of weft yarns 210 to create a ground fabric, where a plurality of pile yarns 410 may be interlaced between the warp and weft yarns 220, 210 of the ground fabric to create the towel. The pile yarns 410 may be visible on the front, back, or both sides of the ground fabric so as to form a raised surface (e.g., extending outwardly) on the ground fabric. Generally, the pile yarns 410 run substantially parallel to the warp yarns 220 and substantially perpendicular to the weft yarns 210, or substantially parallel to the weft yarns 210 and substantially perpendicular to the warp yarns 200. A woven polyester garment material 100 with polyester pile yarns 410 may have the same characteristics as described above regarding TABLES 1-5.

In a preferred embodiment of the present invention, the pile yarns 410 comprise of 100% polyester fibers. Similar to the warp and weft yarns 220, 210, the pile yarns 410 may comprise of multiple polyester yarns twisted together to form plied pile yarns 410. Additionally, the pile yarns 410 are preferably air-jet spun.

In an alternative embodiment of the present invention, the pile yarns 410 form loops 420 between each intersection of the warp or weft yarns 220, 210 (depending on orientation). The loops 420 of the pile yarn 410 assists in capturing moisture from an individual (e.g., wisking moisture away). The loops 420, therefore, enhance the absorbency of the woven garment material 100. Whereas the present invention has been described in detail it is understood that variations and modifications may be effected within the spirit and scope of the invention, as described herein before and as defined in the appended claims. The corresponding structures, materials, acts, and equivalents of all mean-plus-function elements, if any, in the claims below are intended to include any structure, material, or acts for performing the functions in combination with other claimed elements as specifically claimed.

What is claimed is:

1. A quick-drying garment formed of a woven material comprising:

a set of substantially parallel warp yarns;

a set of substantially parallel weft yarns which are selectively interlaced with said warp yarns to form a sheet; and a set of substantially parallel pile yarns selectively interlaced between the warp yarns and weft yarns;

wherein said warp, weft, and pile yarns consist of air-jet spun polyester fibers.

2. The quick-drying garment of claim 1, wherein said warp and weft yarns comprise two or more single strands of yarn and wherein said two or more single strands of yarn are twisted together to form a plied yarn.

3. The quick-drying garment of claim 1, wherein said warp and weft yarns are treated with a flame-retardant.

4. The quick-drying garment of claim 1, wherein said warp and weft yarns are treated with an antimicrobial finish.

5. The quick-drying garment of claim 1, wherein said warp and weft yarns are treated with a stain-resistant finish.

6. The quick-drying garment of claim 1, wherein said quick-drying garment has a dimensional change within the range of −0.8% to −1.6% after one commercial laundering.

7. The quick-drying garment of claim 1, wherein said quick-drying garment has a dimensional change within the range of −0.9% to −1.9% after three commercial launderings.

8. The quick-drying garment of claim 1, wherein said quick-drying garment comprises an edge length having a dimensional change within the range of −1.5% to −1.7% after one commercial laundering.

9. The quick-drying garment of claim 1, wherein said quick-drying garment comprises a center length having a dimensional change within the range of −1.4% to −1.6% after one commercial laundering.

10. The quick-drying garment of claim 9, wherein said center length has a dimensional change of −1.5% after one commercial laundering.

11. The quick-drying garment of claim 1, wherein said quick-drying garment comprises an edge width having a dimensional change within the range of −0.9% to −1.1% after one commercial laundering.

12. The quick-drying garment of claim 11, wherein said edge width has a dimensional change of −1.0% after one commercial laundering.

13. The quick-drying garment of claim 1, wherein said quick-drying garment comprises a center width having a dimensional change within the range of −0.7% to −0.9% after one commercial laundering.

14. The quick-drying garment of claim 13, wherein said center width has a dimensional change of −0.8% after one commercial laundering.

15. The quick-drying garment of claim 1, wherein said quick-drying garment comprises an edge length having a dimensional change within the range of −1.6% to −1.8% after three commercial laundering.

16. The quick-drying garment of claim 15, wherein said edge length has a dimensional change of −1.7% after three commercial laundering.

17. The quick-drying garment of claim 1, wherein said quick-drying garment comprises a center length having a dimensional change within the range of −1.8% to −2.0% after three commercial laundering.

18. The quick-drying garment of claim 17, wherein said center length has a dimensional change of −1.9% after three commercial laundering.

19. The quick-drying garment of claim 1, wherein said quick-drying garment comprises an edge width having a dimensional change within the range of −1.2% to −1.4% after three commercial laundering.

20. The quick-drying garment of claim 1, wherein said quick-drying garment comprises a center width having a dimensional change within the range of −0.8% to −1.0% after three commercial laundering.

21. The quick-drying garment of claim 20, wherein said center width has a dimensional change of −0.9% after three commercial laundering.

22. The quick-drying garment of claim 1, wherein said quick-drying garment has a stain release grade rating within the range of 3.0 to 4.0 after one commercial laundering.

23. The quick-drying garment of claim 1, wherein said quick-drying garment wicks moisture within an absorbency time range of 0.0 to 0.1 seconds.

24. The quick-drying garment of claim 1, wherein said warp yarns have a breaking strength within a range of 134.0 to 135.0 average pounds (lbs.).

25. The quick-drying garment of claim 1, wherein said weft yarns have a breaking strength within a range of 104.0 to 105.0 average pounds (lbs.).

26. The quick-drying garment of claim 1, wherein said quick-drying garment has a water vapor transmission rate greater than or equal to 705 grams $m^2$/24 hours.

27. The quick-drying garment of claim 1, wherein said quick-drying garment has a water vapor transmission rate within a range of 705 to 735 grams $m^2$/24 hours.

28. The quick-drying garment of claim 1, wherein said quick-drying garment has a permeance within a range of $6.3\times10^{-06}$ to $6.6\times10^{-06}$ grams/Pa*s*$m^2$.

29. The quick-drying garment of claim 1, wherein said quick-drying garment has a U.S. permeance within a range of 110.8 to 115.5 grains/in Hg*h*$ft^2$.

30. A quick-drying garment formed of a woven material comprising:

a set of substantially parallel warp yarns;

a set of substantially parallel weft yarns which are selectively interlaced with said warp yarns to form a sheet; and a set of substantially parallel pile yarns, selectively interlaced between the warp yarns and weft yarns, wherein said warp, weft, and pile yarns comprise air-jet spun polyester fibers;

wherein the warp, weft, and pile yarns do not contain natural fibers; and wherein each pile yarn in the set of pile yarns defines a plurality of loops disposed on a first side of the sheet.

31. The quick-drying garment of claim 30, wherein each of the pile yarns is disposed substantially parallel to the warp yarns and substantially perpendicular to the weft yarns.

32. The quick-drying garment of claim 30, wherein each of the pile yarns is disposed substantially parallel to the weft yarns and substantially perpendicular to the warp yarns.

33. The quick-drying garment of claim 30, wherein each of the plurality of loops is disposed at each alternate intersection of the warp yarns and the pile yarns.

34. The quick-drying garment of claim 30, wherein each of the plurality of loops is disposed at each alternate intersection of the weft yarns and the pile yarns.

35. A quick-drying garment formed of a woven material comprising:

a set of substantially parallel warp yarns;

a set of substantially parallel weft yarns which are selectively interlaced with said warp yarns to form a sheet; and a set of substantially parallel pile yarns, selectively interlaced between the warp yarns and weft yarns, wherein said warp, weft, and pile yarns comprise 100% air-jet spun polyester fibers; and wherein each pile yarn in the set of pile yarns defines a plurality of loops disposed on both sides of the sheet.

36. The quick-drying garment of claim 35, wherein each of the pile yarns is disposed substantially parallel to the warp yarns and substantially perpendicular to the weft yarns.

37. The quick-drying garment of claim 35, wherein each of the pile yarns is disposed substantially parallel to the weft yarns and substantially perpendicular to the warp yarns.

38. The quick-drying garment of claim 35, wherein each of the plurality of loops is disposed at each intersection of the warp yarns and the pile yarns.

39. The quick-drying garment of claim 35, wherein each of the plurality of loops is disposed at each intersection of the weft yarns and the pile yarns.

40. The quick-drying garment of claim 35, wherein each loop of the plurality of loops is disposed on an opposite side of the sheet from each adjacent loop.

* * * * *